US007864131B2

(12) United States Patent
Knight et al.

(10) Patent No.: US 7,864,131 B2
(45) Date of Patent: Jan. 4, 2011

(54) VERSATILE WIRE ANTENNA AND METHOD

(76) Inventors: Eric A. Knight, P.O. Box 600, Unionville, CT (US) 06085; Rodney J. Lane, P.O. Box 600, Unionville, CT (US) 06085

( * ) Notice: Subject to any disclaimer, the term of this patent is extended or adjusted under 35 U.S.C. 154(b) by 532 days.

(21) Appl. No.: 11/998,350

(22) Filed: Nov. 29, 2007

(65) Prior Publication Data

US 2009/0295666 A1 Dec. 3, 2009

(51) Int. Cl.
*H01Q 9/16* (2006.01)

(52) U.S. Cl. ..... 343/806; 343/793

(58) Field of Classification Search ..... 343/793, 343/795, 806, 895

See application file for complete search history.

(56) References Cited

U.S. PATENT DOCUMENTS

| | | | | |
|---|---|---|---|---|
| 3,858,220 | A | 12/1974 | Arnow | |
| 6,903,704 | B2 * | 6/2005 | Forster et al. | 343/806 |
| 7,190,319 | B2 * | 3/2007 | Forster et al. | 343/806 |
| 7,375,699 | B2 * | 5/2008 | Forster et al. | 343/806 |
| 7,394,438 | B2 * | 7/2008 | Forster et al. | 343/806 |

* cited by examiner

*Primary Examiner*—Hoang V Nguyen

(57) ABSTRACT

A versatile wire antenna that can be up to 80 percent shorter than traditional wire antennas—while still providing exceptional operating characteristics. The present invention is also more durable than traditional wire antennas, offers broadband and multi-band performance, eliminates tension on the wire components, does not require inductive elements, does not require end insulators or transmission-line feed-point insulators, has low noise characteristics, and offers the potential for significant static-discharge capability. Also disclosed is a method for constructing the present invention.

22 Claims, 5 Drawing Sheets

VERSATILE WIRE ANTENNA AND METHOD

CROSS-REFERENCE TO RELATED APPLICATIONS

Not applicable

FEDERALLY SPONSORED RESEARCH

Not applicable

SEQUENCE LISTING

Not applicable

BACKGROUND

1. Field of Invention

Figure 1:
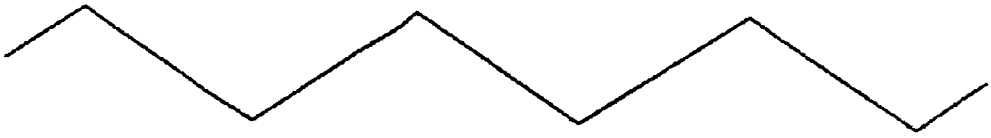

The present invention is in the field of wire antennas, and more specifically provides a versatile wire antenna that can be up to 80 percent shorter than traditional wire antennas—while still providing exceptional operating characteristics. The present invention is also more durable than traditional wire antennas, offers broadband and multi-band performance, eliminates tension on the wire components, does not require inductive elements, does not require end insulators or transmission-line feed-point insulators, has low noise characteristics, and offers the potential for significant static-discharge capability.

2. Description of Related Art

Antennas made of wire are the oldest type of antenna system. They are generally easy to construct, but, particularly on frequencies below VHF (below 30 MHz), their required length can be inconvenient or not practical for the space available for their construction and use.

A common wire antenna used on frequencies below 30 MHz is called a "dipole", in which equal lengths of wire (typically copper wire) are fed by a two-conductor RF transmission line (such as coaxial cable) at a wire junction typically comprised of a ceramic insulator. The combined length of the two wire components is traditionally determined by the formula 468/f, where f is the desired resonance frequency in megahertz and the resultant length is in feet.

For example, for an antenna to be resonant on 3.755 MHz, a frequency in a popular amateur "ham" radio band, the overall length of the wire needed would be approximately 124.6 feet (468 divided by 3.755). In a classic dipole configuration, this length of wire would be divided in two (62.3 feet for each wire radiator) and fed by a two-conductor transmission line. To suspend the wire elements, the far end of each end-point of wire would be attached to insulators, usually made of ceramic or plastic. The insulators would then be fastened to lengths of rope. The rope ends would then typically be fed through pulleys attached to support structures; tension would be applied to the overall rope-and-wire system to create a horizontal antenna system.

One unavoidable problem with this type of antenna is that tension is created throughout the entire system, including the wire elements. Over time, it is common for the wire to stretch and break—and thus requiring the wire element(s) to be repaired or replaced.

Another problem with a common dipole antenna is the overall length required. In the above example, a radio operator may not have the 124.6 feet necessary on his or her property to suspend the dipole. Apartment dwellers and homeowners with small properties may be particularly challenged to find the 124.6 feet of horizontal space without impinging on neighbors' properties.

As inadequate horizontal space is such a common problem, a number of options have been developed to modify a dipole to function at a shorter-than-natural resonant length.

One shorter-length option is to include what is commonly referred to as "loads" in the lengths of wire; these loads are typically comprised of coils and capacitors that electrically simulate a longer length of wire. However, the efficiency and performance of "loaded dipoles" is significantly less than full-length dipoles.

Another shorter-length option is something called a "slinky antenna"—whereby the wire of the antenna is literally made of a child's Slinky toy, which is essentially a coil of spring metal. There are numerous problems and deficiencies with the slinky antenna. One such deficiency is that slinky coils are not ordinarily created by the end-user; the coiling process of the spring steel is beyond the means of most people. Another deficiency is that the slinky antenna can typically only be stretched out to approximately 15 feet without permanently deforming the slinky coil. Other common and reported deficiencies include that the resonance, impedance, and standing-wave ratio (SWR) characteristics of the slinky antenna tend to change when wet. Another deficiency of the slinky antenna is the inherent in the coil itself, as the antenna radiators are essentially large helical inductors which provide unusual and inefficient RF transmission and reception characteristics. All in all, due to these and other deficiencies, the slinky antenna has never gained wide acceptance in the RF-transmission community.

Given the above issues with shortened wire antennas, it would be a great advantage to an antenna user if an antenna could be made shorter and resonant—without "loads" or slinky-like coils. It would be a further great advantage if the antenna can be strung without the wire, itself, bearing the tensile load of the tensioning necessary to keep the wire taut.

OBJECTS AND ADVANTAGES

The present invention overcomes the stated disadvantages of prior shortened wire designs and offers significant advantages over both standard and shortened wire designs. Accordingly, several objects and advantages of the present invention are:

(a) to provide a wire antenna that can be up to 80 percent shorter than traditional wire antennas, (b) to provide a wire antenna that is not only shorter in length than traditional wire antennas, but can also surpass traditional wire antennas in terms of broadband and multi-band performance, (c) to provide a wire antenna that does not require inductors, coils, or any inductive elements whatsoever, (d) to provide a wire antenna that does not place the wire elements under any tensile stress whatsoever, thus (i) greatly expanding the types of wires that can be used in antenna construction and (ii) extending the useful life of the antenna system, (e) to provide a wire antenna that does not require end insulators or transmission-line feed-point insulators, thus (i) saving construction and end-user costs and (ii) eliminating potential failure points in the antenna system, (f) to provide a wire antenna that has low noise characteristics, and (g) to provide a wire antenna that offers the potential for significant static-discharge capability.

DRAWINGS—FIGURES

FIG. 1. Illustration of triangle wave.

Figure 2:
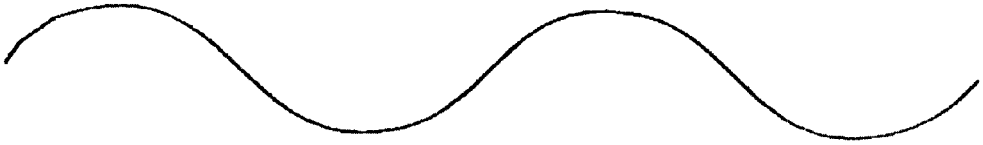

FIG. 2. Illustration of sine wave.

Figure 3:
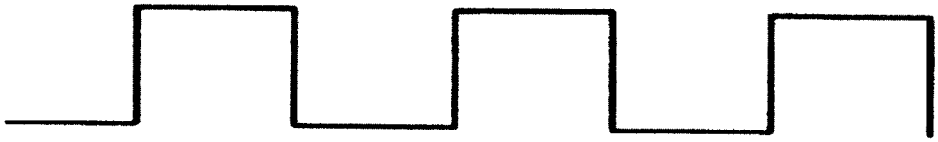

FIG. 3. Illustration of square wave.

Figure 4:
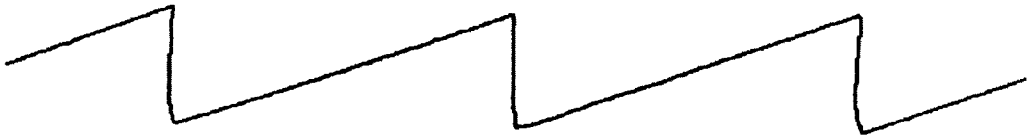

FIG. 4. Illustration of sawtooth wave.

Figure 5:
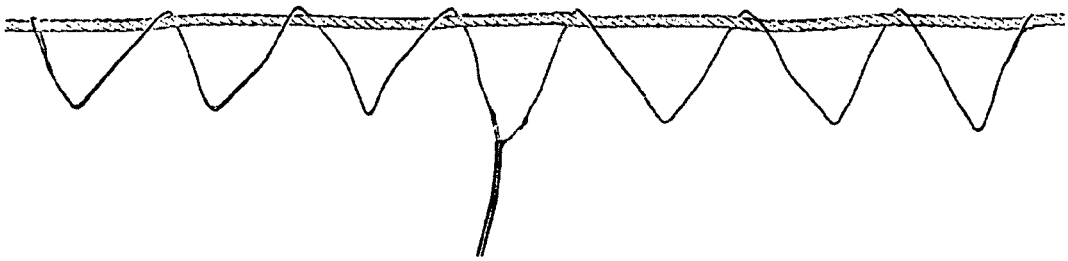

FIG. 5. Embodiment of present invention with wire draped over rope at each wave apex; coax feed line.

Figure 6:
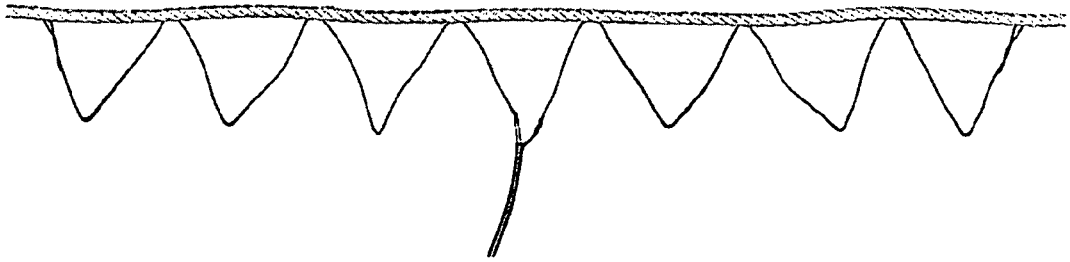

FIG. 6. Embodiment of present invention with wire inserted into rope at each wave apex; coax feed line.

Figure 7:
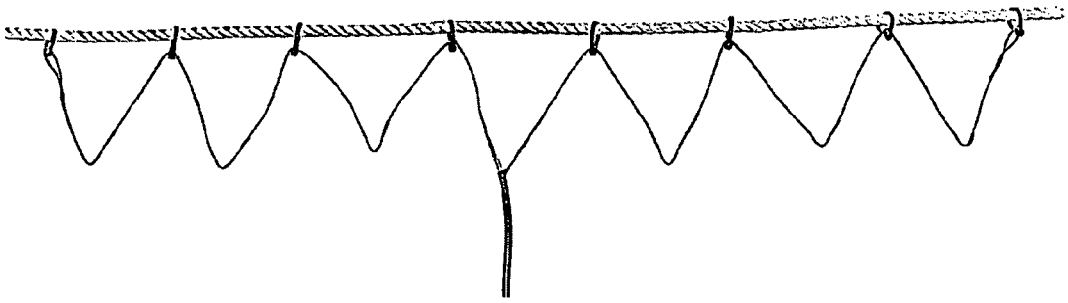

FIG. 7. Embodiment of present invention with loops made of nylon zip ties formed over rope; wire suspended by zip ties at each apex; coax feed line.

Figure 8:
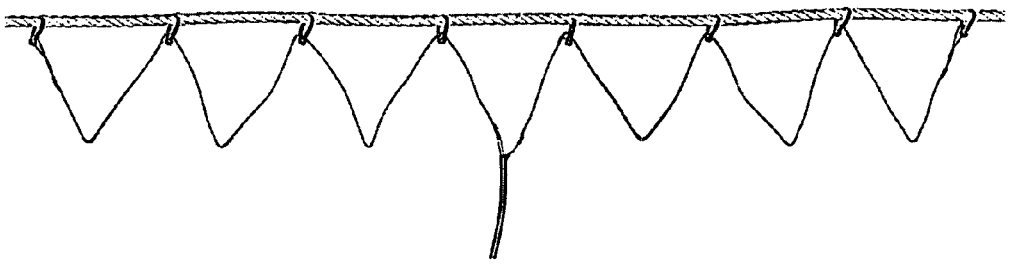

FIG. 8. Embodiment of present invention with loops made of nylon zip ties formed and inserted into rope; wire suspended by zip ties at each apex; coax feed line.

Figure 9:
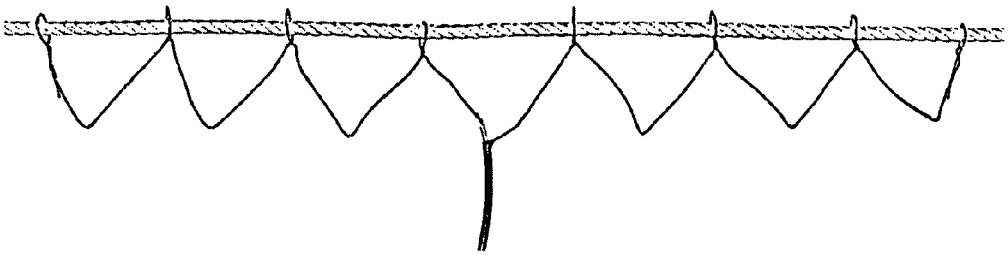

FIG. 9. Embodiment of present invention with loops formed in wire at each wave apex; rope inserted through wire loops; coax feed line.

Figure 10:
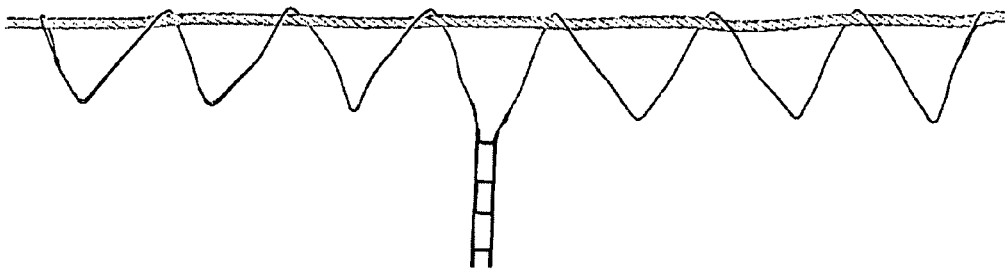

FIG. 10. Embodiment of present invention with wire draped over rope at each wave apex; parallel-conductor feed line.

Figure 11:
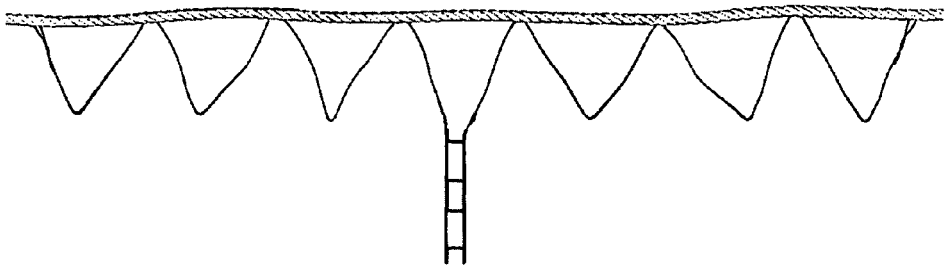

FIG. 11. Embodiment of present invention with wire inserted into rope at each wave apex; parallel-conductor feed line.

Figure 12:
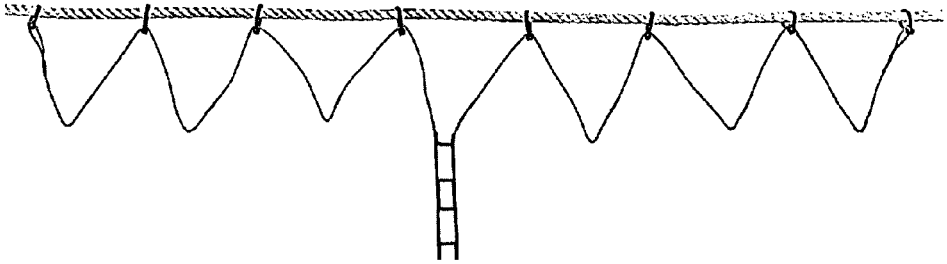

FIG. 12. Embodiment of present invention with loops made of nylon zip ties formed over rope; wire suspended by zip ties at each apex; parallel-conductor feed line.

Figure 13:
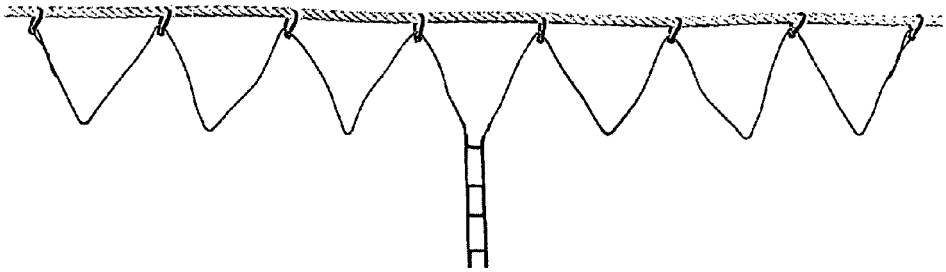

FIG. 13. Embodiment of present invention with loops made of nylon zip ties formed and inserted into rope; wire suspended by zip ties at each apex; parallel-conductor feed line.

Figure 14:
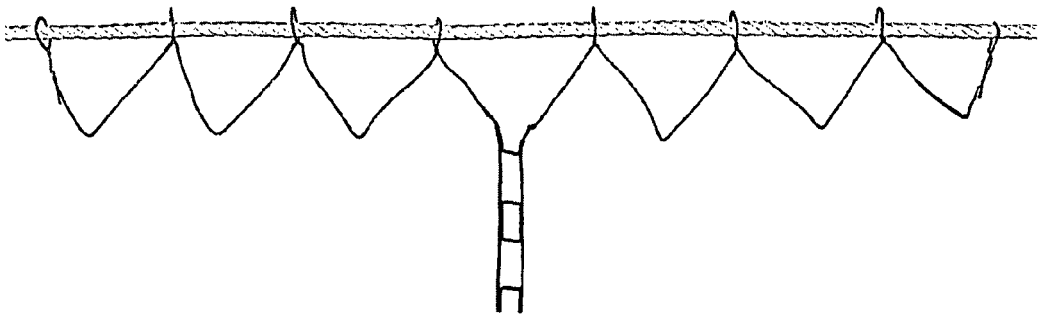

FIG. 14. Embodiment of present invention with loops formed in wire at each wave apex; rope inserted through wire loops; parallel-conductor feed line.

DETAILED DESCRIPTION—PREFERRED EMBODIMENTS

The versatile wire antenna invention is primarily based upon forming the antenna wire into a repetitive wave shape. Examples of wave-shape options include a triangle wave, sine wave, square wave, and sawtooth wave—as illustrated in FIG. 1, FIG. 2, FIG. 3, and FIG. 4 respectively. Each wave shape offers various performance and installation opportunities. The exploration of the benefits of each wave-shape variation—as well as the benefits of other wave shapes and multiple wave-shape combinations—is ongoing.

For illustrative simplicity, the embodiments described herein are based on a triangle wave. However, this should not limit the scope of the invention, but broaden the possibilities of the present invention to be based on a variety of wave shapes—including sine, square, and sawtooth waves.

A typical embodiment of the versatile wire antenna is illustrated in FIG. 5. The antenna system includes a length of wire formed into continuous triangle wave shape which is draped over a length of support rope. The wire is supported entirely by the rope at each triangle-wave apex. The antenna wire is divided at the midpoint wave valley; a coax feed line is attached to the ends of the wire created by the wire division.

It is important to note that the antenna wire may be divided at other points along the wire length, not just at the midpoint valley. Other wave valleys may be selected, based on user preference, antenna radiation-pattern preference, antenna installation needs, and/or feed line matching requirements.

Adjustments in the overall length of the antenna can be achieved by increasing or decreasing the angles that make up the triangles—essentially expanding or contracting the waves of the triangles in accordion-like fashion. Overall antenna lengths can thus be easily configured to match a user's needs and operational requirements. For instance, for a user desiring a very compact antenna, the angles of the triangles can be reduced to provide a reduction in overall antenna length of up to 80 percent (and, perhaps, even more)—while still providing outstanding operating and performance characteristics.

Another embodiment of the present invention is illustrated in FIG. 6. In this embodiment, the wire is inserted into the weave of the rope at each wave apex, versus draped over the rope at each wave apex as depicted in FIG. 5.

A further embodiment of the present invention is illustrated in FIG. 7. This embodiment utilizes loops made of nylon zip ties formed over the support rope; the antenna wire is suspended by the zip ties at each apex—similar in concept to hanging a shower curtain on a shower rod.

And another embodiment of the present invention is illustrated in FIG. 8. This particular embodiment is similar to the embodiment depicted in FIG. 7, except that the loops of zip ties are inserted into the weave of the rope.

It should be mentioned that zip ties were used as a matter of convenience in these example embodiments, and should not limit the scope of options in determining the actual construction of the loops used to suspend the wire. In fact, custom-manufactured rings of plastic or other appropriate material could very well be a suitable option.

FIG. 9 represents another variant of the current invention. In this particular embodiment, the need for separate hanging loops is avoided altogether, as the loops are twisted into the apex of the antenna wire itself. The support rope is fed through wire-made loops, so that the antenna wire (as in the other depicted embodiments) is supported at each wave apex.

Another embodiment, not depicted, is similar to FIG. 9—but instead of the support rope fed through the wire-made loops, the wire-made loops are inserted into the weave of the rope.

FIG. 10-FIG. 14 are identical to their respective counterparts FIG. 5-FIG. 9, except that the feed line is parallel-conductor feed line instead of coax.

Additional Embodiments

It's important to note an additional series of embodiments. These embodiments are not depicted, as they are essentially a subtle variation that spans all aforementioned embodiments. It is quite reasonable to consider substituting a stiff insulative rod (fiberglass rod, plastic rod, PVC pipe, etc.) for the support rope in the previous figures. For those embodiments where the wire or nylon zip ties are inserted into the weave of the rope at each wave apex, the wire or nylon zip ties can be inserted into the stiff rod through holes created in the rod. Embodiments utilizing stiff rods rather than rope as the wire-support mechanism might be particularly useful for short-wavelength antennas, where the wire spans can be considerably shorter.

It should also be noted that although two types of feed lines are indicated and described in the embodiments, this should not limit the scope of the invention. Other types of feed lines may be considered and chosen by the user such as HELIAX—a brand name of high-performance coaxial cable from Andrew Corporation.

It is also important to mention that multiple types of feed lines, operating in tandem, are also reasonable choices as overall antenna-feed methods. For instance, a predetermined length of coax feed line could be connected to a predetermined length of parallel-conductor feed line. This combined feed-line approach could be selected and used for a variety of reasons, including impedance matching, offsetting the influences of conductive elements that are near the feed line, and/or user convenience or preference.

Although not required, the user/builder could chose to incorporate one or more baluns (or the like) in the antenna-feedline system to provide, for instance, impedance matching and/or transitions between balanced and unbalanced elements.

Virtually Unlimited Orientation Options

Although the embodiment examples herein depict substantially horizontal orientation of the versatile wire antenna invention, this should not be construed as a limitation. On the contrary, the design of the present invention allows for any orientation, including steep slopes. In fact, even vertical orientation of the versatile wire antenna is appropriate for some circumstances, particularly for those users who wish substantially omnidirectional radiative and reception patterns. In this particular case, only one support point is necessary—one at the very top—and the antenna would hang down vertically due to gravity. Of course, a user may elect to anchor the bottom end in a convenient fashion, to minimize antenna motion due to wind or other external force.

Straight and Angular Options; Multiple Anchor-Point Options

It should be further noted that the rope of the present invention does not have to form a straight line. As an example, the rope of the present invention could have more than two anchor points, such as a high point in the center (at the typical location of feed line attachment) and two lower points on the rope ends; the result would be an upside-down "V" configuration that might be better suited to a user's home-property situation and/or provide particular performance characteristics.

Operation

The operation of the versatile wire antenna is straightforward, particularly for those skilled in the art of antenna use and RF transmissions. The transmitter, receiver, or transceiver to be used is simply connected to the present invention's feed line—either directly or through what is commonly referred to as an "antenna tuner". An antenna tuner typically uses a combination of variable capacitors and inductors to match the impedance of an antenna to that of the transmitter, receiver, or transceiver.

No special knowledge is required to use the present invention and experience the invention's many advantages and benefits.

Advantages Over Traditional Wire Antennas

The present invention is extremely versatile—much more so than traditional wire antennas. The present invention can be installed and configured as is suitable for the user and property; the described embodiments and described variations are just a few of the nearly unlimited options and opportunities that are possible.

It's not uncommon for the end points of the support rope to be anchored between trees, masts, and building structures; the present invention can even be used indoors in space-limited areas—such as attics.

The wave shapes can be greatly compressed in accordion-like fashion, providing an antenna system that can be shorter than traditional wire antennas by up to 80 percent (and, possibly, even shorter). Thus, the present invention can be adjusted to fit and function in just about any usable space.

Further Advantages

Of course, a primary benefit of the present invention is its compact, flexible, versatile design that can be used in many more locations than traditional wire antennas—especially in space-restricted locations. However, even in locations where space constraints are not issues, a user many prefer the present invention over traditional wire antennas due to its other substantial construction, operational, and performance benefits.

For instance, upon operation, the user will notice substantial broadband and multi-band performance. In terms of broadband performance, the present invention will stay "tuned" over wide frequency ranges, as noted by low SWR over wide portions of a particular frequency band. For instance, once the present invention is tuned for a particular band with an antenna tuner, minimal—If any—antenna-tuning adjustments are required to operate throughout the entire band.

One of the most-common failure modes of a traditional wire antenna is the stretching and snapping of wire elements, as they bear the full supportive tensile load. A major advantage of the present invention over other wire antennas is that the wire elements are not under any tensile load whatsoever. This significant advantage greatly expands the types of wires that can be used in antenna construction. Even very fine wires that have low tensile strength are very reasonable candidates. Since the present invention's wires are not under tensile load, the useful life of the antenna system is dramatically extended.

The present invention does not require inductors, coils, or any inductive elements whatsoever, a design feature that provides many advantages. First off, construction costs are minimized. Secondly, the design eliminates the transmission and performance losses that can be incurred by the addition of inductive elements. And thirdly, eliminating the need for inductive elements provides for greater antenna longevity, as there are minimal components that can fail in the system.

The present invention also does not require end insulators or insulators at the feed point of the feed line. Construction and end-user costs are reduced, and potential failure points in the system are eliminated.

Testing of the present invention has shown low noise characteristics versus standard wire antennas. Further research into this invention advantage is ongoing. Another advantage—significant static-discharge capability—is currently being studied and evaluated. The multiple waveform apexes of the present invention seem to allow for greater dissipation of air-ionization energy than the substantially linear lengths of wire that comprise traditional wire antennas. Further research into this invention advantage will continue.

Real-World Performance Tests

An almost unlimited combination of wire lengths, waveform types, wave amplitudes, and numbers of waves per unit of distance (i.e., wave frequency) are viable options—chosen primarily by the builder's/user's particular installation-space and operational requirements. Since the invention was first conceived on Nov. 15, 2003, experiments have been conducted with various designs and configurations; with antenna constructions spanning from just a few inches to well over 100 feet.

A significant test occurred during Jun. 23-24, 2007, when the present invention was used during the popular annual amateur "ham" radio event called "Field Day". The chosen invention variation was similar to that represented in FIG. 12. This particular embodiment was composed of 102 feet of 14 AWG stranded copper wire formed into 102 triangle waves;

each segment of the wire wave was six inches long. The antenna utilized 3/16" double-braided polyester rope as its support member. The overall span of the antenna was approximately 46 feet. The antenna was centrally fed with approximately 100 feet of 450-ohm parallel-conductor "ladder" feed line.

Following the success of the present invention during the Field Day event, another antenna of the invented design was constructed and continues to be in use. The chosen invention variation is similar to that represented in FIG. 13. This particular invention example is composed of 102 feet of 14 AWG stranded copper wire formed into 102 triangle waves; each segment of the wire wave is six inches long. The antenna utilizes 5/16" hollow-braid polypropylene rope as the support member. The supporting loops are fabricated by inserting commonly available nylon zip ties into the rope's hollow braid, then over the wire at each apex, and then cinched down to form ½" diameter loops.

The overall span of this particular antenna embodiment is approximately 51 feet. The antenna is centrally fed with approximately 150 feet of 450-ohm parallel-conductor "ladder" feed line.

A particularly substantial test of this embodiment of the present invention occurred during Nov. 17-18, 2007, when it was used during a ham radio event called "Sweepstakes". The present invention was connected to a Yaesu FT-840 transceiver, with approximately 100 watts of RF output, via an MFJ Deluxe Versa Tuner II antenna tuner. Over a cumulative operating time of seven hours and twenty three minutes, a total of 63 contacts were made with fellow ham radio operators, spanning the following ham radio "sections" (regions) of the United States:

Connecticut; Maine; eastern New York; Maryland/Washington, D.C; Georgia; North Carolina; northern Florida; southern Florida; west-central Florida; Virginia; Louisiana; New Mexico; northern Texas; southern Texas; western Texas; East Bay (San Francisco Bay area), Calif.; Los Angeles, Calif.; Santa Clara Valley, Calif.; San Diego County, Calif.; Arizona; Nevada; Utah; western Washington; Michigan; Ohio; Illinois; Indiana; Wisconsin; Minnesota; Missouri; Nebraska; South Dakota; Puerto Rico; and the Virgin Islands.

During the same span of time, contacts were also made with ham radio operators in Newfoundland, Canada and Ontario, Canada.

During the Sweepstakes event, this particular embodiment of the present invention performed well across the amateur-radio HF bands, including the 80-, 40-, 20-, and 15-meter bands. Note that this particular embodiment has been used on other amateur-radio bands, such as the 160- and 10-meter bands, but it was not chosen for operation on these bands during the Sweepstakes event.

Over the course of the Sweepstakes event, the present invention offered impressive "broadband" performance across all of the bands used. Once the present invention was tuned with the antenna tuner, the antenna did not have to be retuned to maintain acceptable SWR across each band.

Another benefit of the present invention, particularly evident during the Sweepstakes event, was that the present invention picked up substantially less noise than a traditional wire dipole that was also installed at the same location.

It is very important to note that although the invention embodiment currently installed is optimized for the amateur-radio bands and frequencies, there does not seem to be any particular limitation to the bands and frequencies the present invention can be used for. In this regard, investigations are ongoing to evaluate the potential uses and applications of the present invention in the following areas of the radiofrequency spectrum:

Very Low Frequency (VLF) 3 kHz-30 kHz
Low Frequency (LF) 30 kHz-300 kHz
Medium Frequency (MF) 300 kHz-3 MHz
High Frequency (HF) 3 MHz-30 MHz
Very High Frequency (VHF) 30 MHz-300 MHz
Ultra High Frequency (UHF) 300 MHz-3 GHz
Super High Frequency (SHF) 3 GHz-30 GHz
Extremely High Frequency (EHF) 30 GHz-300 GHz

CONCLUSION, RAMIFICATIONS, AND SCOPE

Accordingly, the reader will see that the versatile wire antenna provides:

(a) a wire antenna that can be up to 80 percent shorter than traditional wire antennas,
(b) a wire antenna that is not only shorter in length than traditional wire antennas, but can also surpass traditional wire antennas in terms of broadband and multi-band performance,
(c) a wire antenna that does not require inductors, coils, or any inductive elements whatsoever,
(d) a wire antenna that does not place the wire elements under any tensile stress whatsoever, thus
  (i) greatly expanding the types of wires that can be used in antenna construction and
  (ii) extending the useful life of the antenna system,
(e) a wire antenna that does not require end insulators or transmission-line feed-point insulators, thus
  (i) saving construction and end-user costs and
  (ii) eliminating potential failure points in the antenna system,
(f) a wire antenna that offers low noise characteristics, and
(g) a wire antenna that offers the potential for significant static-discharge capability.

Although the description above contains many specificities, these should not be construed as limiting the scope of the invention but as merely providing illustrations of some of the presently preferred embodiments. For instance, the versatile wire antenna can be oriented horizontally, vertically, or at any angle or combinations of angles that are chosen by the builder or user. The antenna wire wave shapes can be uniform in type, amplitude, and frequency, or mixed in type, amplitude, and frequency. The antenna wire can be insulated, non-insulated, or any combination thereof. The antenna wire can be solid or stranded, stiff or flexible, large or small gauge, or any combination thereof. The present invention can be supported by one, two, or any number of support/anchor points as chosen by the builder and/or user. The support rope of the present invention can be of virtually any substantially insulative material capable of supporting the present antenna. The support rope of the present invention does not have to form a straight line, but can also be configured to wrap around and over objects, have multiple angles, have multiple anchor points, etc. In addition to support rope, monofilament support line (such as nylon fishing line) is also a viable option for the antenna support member. As previously described, as an alternative to support rope and support line, embodiments of the present invention may utilize insulative rod as the wire-support member. A wide variety of materials can be considered for the insulative rod member, including fiberglass rod, plastic rod, PVC pipe, and other rigid or semi-rigid insulative materials. Multiple insulative rods may be used in tandem. Also appropriate are invention variants and embodiments that include combinations of rope, monofilament line, and rods as support members. It is also conceivable that the present invention's insulative support member is inherent in a separate structure. For instance, the present antenna could conceivably be mounted to a home's vinyl siding or vinyl gutters using appropriate hooks or hangers that interface with the apexes of the antenna's wave shapes.

While the invention has been described in detail with respect to the preferred embodiments thereof, it will be appreciated that upon reading and understanding of the foregoing, certain variations to the preferred embodiments will become apparent, which variations are nonetheless within the spirit and scope of the invention and the appended claims.

The spirit and scope of the invention should be determined by the appended claims and their legal equivalents, rather than by the examples given.

What is claimed is:

1. A versatile wire antenna comprising:

(a) a predetermined length of wire formed into a repetitive series of wave shapes, (b) a substantially linear insulative support member of predetermined length, (c) said length of wire hung by said substantially linear insulative support member via the apexes of said wave shapes, (d) said length of wire extended longitudinally along said substantially linear insulative support member in a substantially single plane, and (e) said length of wire divided at a predetermined location to enable attachment to a predetermined length of feed line.

2. The versatile wire antenna of claim 1 wherein said wave shapes are triangle waves.

3. The versatile wire antenna of claim 1 wherein said wave shapes are sine waves.

4. The versatile wire antenna of claim 1 wherein said wave shapes are square waves.

5. The versatile wire antenna of claim 1 wherein said wave shapes are sawtooth waves.

6. The versatile wire antenna of claim 1 wherein said substantially linear insulative support member is taut rope.

7. The versatile wire antenna of claim 1 wherein said substantially linear insulative support member is taut monofilament line.

8. The versatile wire antenna of claim 1 wherein said substantially linear insulative support member is insulative rod.

9. The versatile wire antenna of claim 1 wherein said feed line is coax cable.

10. The versatile wire antenna of claim 1 wherein said feed line is parallel-conductor line.

11. The versatile wire antenna of claim 1 wherein said feed line is any radiofrequency feed line that is appropriate for the task and requirements of the user.

12. A method for creating a versatile wire antenna comprising the steps of:

(a) forming a predetermined length of wire into a repetitive series of wave shapes, (b) mounting a substantially linear insulative support member of predetermined length, (c) hanging said length of wire on said substantially linear insulative support member via the apexes of said wave shapes, (d) extending said length of wire longitudinally along said substantially linear insulative support member in a substantially single plane, and (e) dividing said length of wire at a predetermined location to enable attachment to a predetermined length of feed line.

13. The method for creating a versatile wire antenna of claim 12 wherein said wave shapes are triangle waves.

14. The method for creating a versatile wire antenna of claim 12 wherein said wave shapes are sine waves.

15. The method for creating a versatile wire antenna of claim 12 wherein said wave shapes are square waves.

16. The method for creating a versatile wire antenna of claim 12 wherein said wave shapes are sawtooth waves.

17. The method for creating a versatile wire antenna of claim 12 wherein said linear insulative support member is taut rope.

18. The method for creating a versatile wire antenna of claim 12 wherein said linear insulative support member is taut monofilament line.

19. The method for creating a versatile wire antenna of claim 12 wherein said linear insulative support member is insulative rod.

20. The method for creating a versatile wire antenna of claim 12 wherein said feed line is coax cable.

21. The method for creating a versatile wire antenna of claim 12 wherein said feed line is parallel-conductor line.

22. The method for creating a versatile wire antenna of claim 12 wherein said feed line is any radiofrequency feed line that is appropriate for the task and requirements of the user.

* * * * *